United States Patent [19]

Estrov

[11] Patent Number: 5,010,314

[45] Date of Patent: Apr. 23, 1991

[54] LOW-PROFILE PLANAR TRANSFORMER FOR USE IN OFF-LINE SWITCHING POWER SUPPLIES

[75] Inventor: Alexander Estrov, Newton, Mass.

[73] Assignee: Multisource Technology Corp., Waltham, Mass.

[21] Appl. No.: 502,523

[22] Filed: Mar. 30, 1990

[51] Int. Cl.[5] ..... H01F 27/30

[52] U.S. Cl. ..... 336/198; 336/183; 336/200; 336/232

[58] Field of Search ..... 336/200, 198, 208, 206, 336/232, 180, 183

[56] References Cited

U.S. PATENT DOCUMENTS 3,609,859 10/1971 Hant et al. ..... 336/198 X 4,837,544 6/1989 McDougal ..... 336/198 X

*Primary Examiner*—Thomas J. Kozma

*Attorney, Agent, or Firm*—Wolf, Greenfield & Sacks

[57] ABSTRACT

A low-profile planar type transformer having a unique bobbin design and a minimum of other pieces. The transformer is assembled by simply stacking all of the pieces, other than core pieces, in a sandwich-like-laminate and placing two appropriately shaped ferrite core pieces around the stack. In the preferred embodiment, the stack consists of the following layers, in the listed order: (a) a first thin dielectric spacer; (b) a first planar member (e.g., a PC board) containing a first winding; (c) two thin dielectric insulators; (d) a first nylon bobbin member; (e) a second planar member containing a second winding; (f) a third thin dielectric insulator; (g) a third planar member containing a third bobbin member; (h) a second nylon bobbin member; (i) two thin dielectric insulator; (j) a fourth planar member containing a fourth widning, and (k) a seventh thin dielectric insualtor. Two E-shaped ferrite cores are placed around the stack, with the center arm of the "E" going through a hole in the middle of the stack, to magnetically couple the current in the second planar member's windings to the windings of the first and third planar member.

3 Claims, 10 Drawing Sheets

LOW-PROFILE PLANAR TRANSFORMER FOR USE IN OFF-LINE SWITCHING POWER SUPPLIES

FIELD OF THE INVENTION

This invention relates to the design of high frequency transformers and, more particularly, to low-profile planar, or printed circuit board type, transformers that will meet the isolation safety standards set for transformer use on AC mains, such as in off-line switching power supplies.

BACKGROUND OF THE INVENTION

Switching power supplies have long been of great interest to product designers because of their compact size relative to their linear counterparts. But, it was not until the second half of the 1980's that switching power supplies (i.e., "switchers") became the power supply of choice in the design of most electronic equipment. Their increased popularity was largely due to the availability of switchers that were more compact, lighter in weight, equally as reliable, yet only slightly more expensive than linear designs of equivalent power rating.

The key to the appearance of highly reliable, compact switcher designs was the availability of high-frequency switching transistors that could withstand the high voltage transients which appear on AC mains. With the development of FET's and other types of fast switching transistors that could operate reliably in the AC mains environment, off-line type switching power supplies, designed around small transformers, became practical. Thus, the large, 50 and 60 Hertz, iron core transformers that were required in the classical linear power supplies were replaced by higher-frequency transformers that greatly reduced their size and weight. Consequently, the switching power supplies of today are smaller, lighter in weight and more efficient than previous linear designs.

However, with the constant push to miniaturize electronics products there is a never-ending demand for even smaller and lighter power supplies This translates into a demand for smaller transformers, since the transformer is still the largest and heaviest component, even in today's switching power supplies.

It is well understood that small transformers are quite realizable for use at MegaHertz frequencies. However, the transformer in an off line switcher must operate in the AC mains environment. This means that there are stringent isolation requirements which any such transformer design must satisfy. Since isolation is largely an issue of the separation and insulation between wires, windings, layers of windings and connections, it is apparent that the isolation requirements work against minimizing size. This trade-off has significant quality control. inspection and cost implications.

One of the most promising techniques for designing small, high-frequency, transformers is the low-profile planar, or printed circuit board (i.e., PCB) style of transformer. In this type of transformer, the primary windings, which are a spiral of traces on a planar surface, are coupled to the secondary windings, which are a different spiral of traces on a separate planar surface, by enclosing the windings in a magnetic housing. Typically, the magnetic housing is made of ferrite, Sumarium or some other composite material that is shaped as a pot-core, an R-M core, an E core, an I core, etc. But, it can be almost any shape that is easy to place around the windings and effectively confines the magnetic field to the area around the windings.

The use of planar traces rather than the classical wire windings on a bobbin is a significant manufacturing advance for high-frequency transformers. However, the international safety standards for interwinding isolation have presented a stumbling block in applying this construction technique to the miniaturization of transformers for off-line switchers. The requirements for isolation necessitate interwinding distances that, before this invention, could only have been addressed by the brute force approach of using thick bobbins, and many layers of insulating spacers. These, though, would not have been efficient transformers because they would have required relatively large magnetic elements, to compensate for the poor coupling between the primary and the secondary windings. Consequently, the inability to satisfy the international safety requirements in a small, light-weight, efficient design has kept low-profile planar transformers out of consumer products, and away from the AC mains. Low-profile planar transformers have been limited to military products, where less isolation is required, and to DC-to DC switchers, where the input is a low DC voltage, not the AC mains. Nevertheless, the real challenge for planar transformers is to be approved for use in consumer oriented off-line switchers. But, in order to be approved for such applications there are specific isolation requirements that they must meet. These are the requirements of the safety certification agencies throughout the world. These agencies define how to measure safety in virtually all consumer products, and these same agencies pass or fail electrical and mechanical products against their published safety specifications.

Almost every country has its own safety agency; however, the most influential and commercially most important among the international agencies are Underwriters' Laboratory (U.L.) in the USA, V.D.E. in Germany, and C.S.A. in Canada. In the case of power transformers that operate at both 110VAC and 220VAC, the U.L., V.D.E, and C.S.A standards that challenge the transformer designer are: (A) the primary winding-to-SELV winding (Safe Extra Low Voltage winding) insulation thickness must be either one insulator that is at least 2 mm (0.080") thick, or three layers of insulation each at least 0.1 mm (0.004") thick (i.e., 3 plys); (B) the "creepage" and "clearance" between the low voltage, secondary winding and either AC line or neutral must be at least 6 mm (0.240"); and (C) the "creepage" and "clearance" between the core and either line or neutral must be at least 2 mm (0.080"). "Creepage" and "clearance" are investigated between conductors, conductors and terminals, grounded or ungrounded conductive parts, components and component leads. "Creepage" is defined as the shortest path between two conductive parts or between a conductive part and the grounding surface of the equipment measured along the surface of the insulation. "Clearance" is the shortest distance between two conductive parts as measured through air. If a barrier is interposed, the spacing is measured around the barrier, or, if the barrier consists of two or more uncemented pieces, the spacing is measured through a joint or around the barrier, whichever is least.

While providing low profile and high-efficiency, PC board (i.e., low profile planar) type transformers for off-line switchers have had difficulty meeting the above requirements.

Therefore, an object of this invention is to provide a low profile planar transformer design and physical construction concept that easily meets the above-stated isolation requirements for use in commercial off line switchers.

It is a further object of this invention to provide an inexpensive to manufacture, low-profile planar transformer with creepage and clearance values that easily meet the VDE specifications while packaged in a small volume and height.

It is yet another object of this invention to provide a bobbin design for a planar transformer that retains the windings in a minimum profile housing while providing the necessary creepage and clearance between the primary and secondary windings.

Another object of this invention is to provide a high-frequency transformer that is useful in consumer applications where it must provide isolation from AC mains.

Another object is to provide a transformer that is the basis for cost-effective consumer-oriented off-line switchers.

It is still a further object of this invention to provide a high frequency transformer that is inexpensive to manufacture.

SUMMARY OF THE INVENTION

These and other objects are achieved in a low-profile planar type transformer having a unique bobbin design and a minimum of other pieces. The transformer is assembled by simply stacking all of the pieces, other than core pieces, in a sandwich-like-laminate and placing two appropriately shaped ferrite core pieces around the stack.

In the preferred embodiment, the stack consists of the following layers, in the listed order: (a) a first thin dielectric spacer; (b) a first planar member containing a first winding; (c) two thin dielectric insulators; (d) a first nylon bobbin member; (e) a second planar member containing a second winding; (f) a third thin dielectric insulator; (g) a third planar member containing a third bobbin member; (h) a second nylon bobbin member; (i) two thin dielectric insulators; (j) a fourth planar member containing a fourth winding, and (k) a seventh thin dielectric insulator. Two E-shaped ferrite cores are placed around the stack, with the center arm of the "E" going through a hole in the middle of the stack, to magnetically couple the current in the second planar windings to the windings of the first and third planar member.

The replacement of the classical transformer having wire wound around a sewing style bobbin by planar windings placed inside a tray-like bobbin makes the entire assembly low profile, and being adaptable to low cost mass-production. The simplicity of the construction makes the transformer very easy to assemble either by hand or by machine. Furthermore, once the transformer is assembled, the design assures that it will meet the isolation requirements of the safety agencies as mentioned above. More specifically, it is the design of the bobbin members which assures that compliance.

In fact, it is the path along the surface of each bobbin member from its top surface to its bottom surface that allows the transformer to meet the creepage and clearance requirements. Each bobbin member comprises a flat surface (i.e., planar element) with a central aperture. On each surface of the planar element, a wall extends around the area in which the winding will sit. Walls also extend around the central aperture, from both the top and bottom surfaces of the planar element. The walls create a tray-like arrangement and act as path extenders for the creepage and clearance measurements, while hardly effecting the profile of the transformer.

Thus the transformer of this invention is inexpensive to make, has a low profile, and (with proper dimensions) meets the international safety standards for electrical isolation.

BRIEF DESCRIPTION OF THE DRAWING

In order that the invention may be fully understood, it will now be described by way of example and with reference to the accompanying drawing in which.

DETAILED DESCRIPTION

FIGS. 1 through 12 illustrate an exemplary embodiment of a PCB transformer according to the present invention, and its constituent elements. Selected dimensions are shown, but anyone skilled in the art will understand that many of the dimensions, and the shape, depend upon the low frequency cut-off specification of the transformer and other design factors. The indicated dimensions are for a transformer that operates between 100K-1M Hertz at 100 to 250 Watts.

Figure 1:
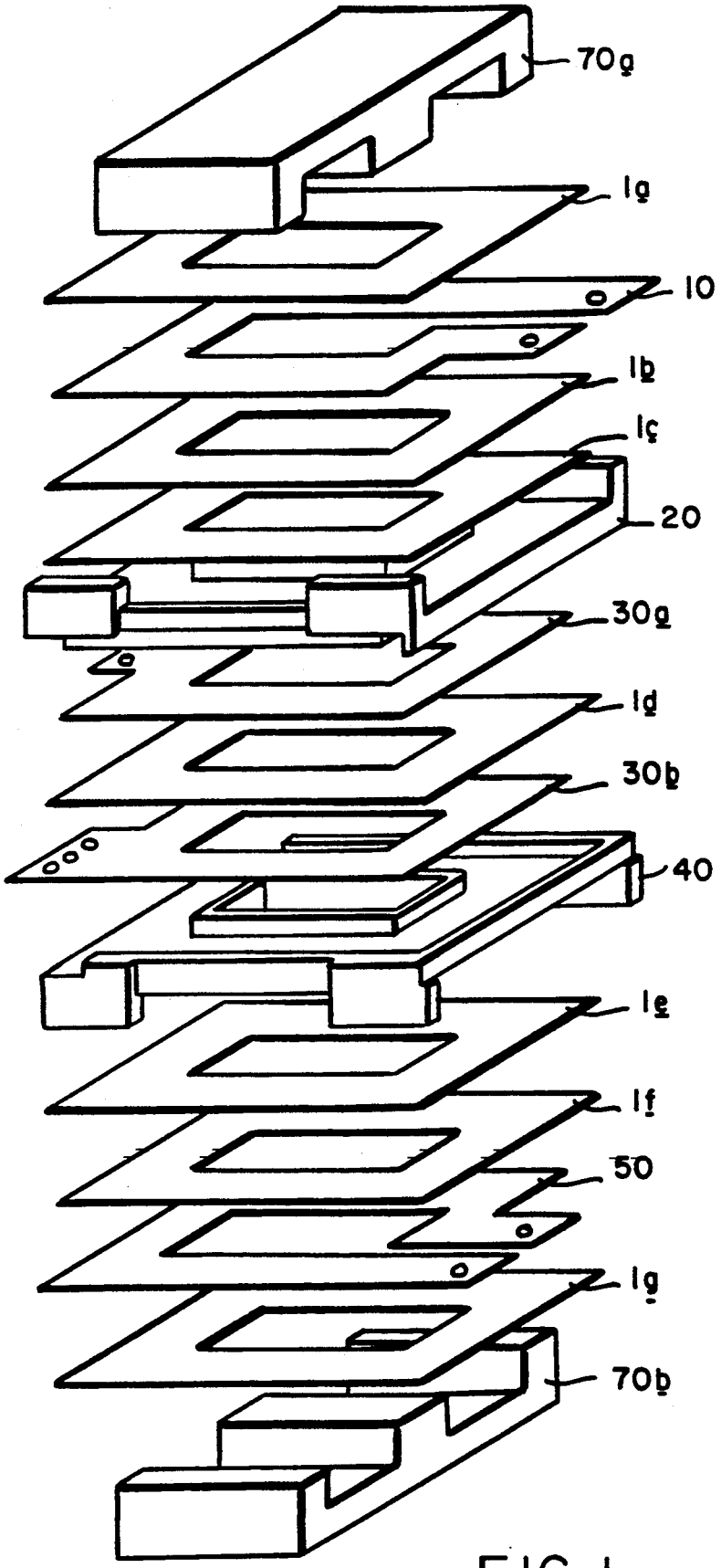
FIG. 1 is a exploded view of the preferred embodiment of a transformer assembly according to this invention.

FIG. 1 depicts an exploded view of the preferred embodiment. The elements of the transformer are: a first thin dielectric insulator 1*a;* a first planar member (which may be a PC board, not expressly shown) containing a first planar winding 10; second and third thin dielectric insulators 1*b* and 1*c* under winding 10; a first insulating bobbin member 20; a second planar member (which may include a PC board, not expressly shown) containing a second planar winding 30*a;* a fourth thin dielectric insulator 1*d;* a third planar member (which also may include a PC board, not expressly shown) containing a fourth planar winding 30*b;* a second insulating bobbin member 40; fifth and sixth thin dielectric insulators 1*e* and 1*f;* a fourth planar member (also possibly having a PC board, not expressly shown) containing a fourth planar winding 50; a seventh thin dielectric insulator 1*g;* and two E shaped ferrite core members 70*a* and 70*b*.

Figure 2C:
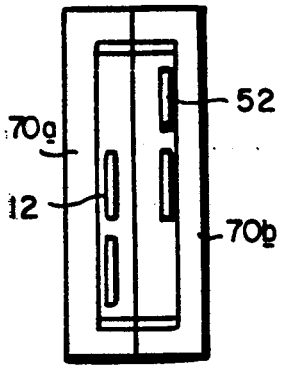
FIG. 2B is a front plan view and FIG. 2C is a side view of the assembled transformer of FIG. 1.
Figure 2A:
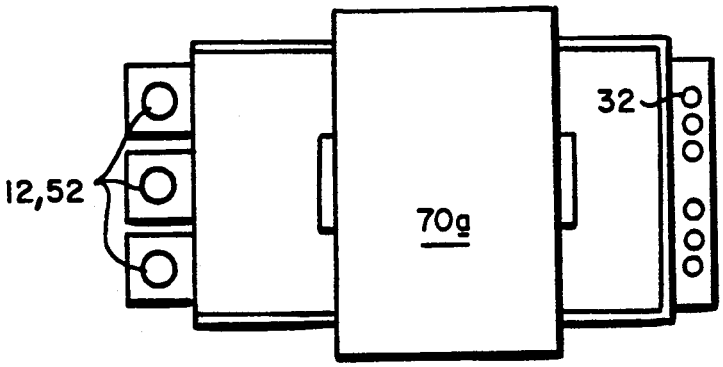
FIG. 2A is a top plan view.
Figure 2B:
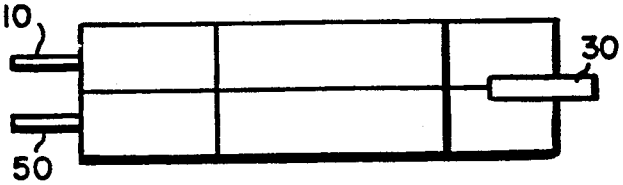

FIGS. 2A-2C provide top, front and side plan views of the fully assembled transformer shown in FIG. 1.

Figure 3A:
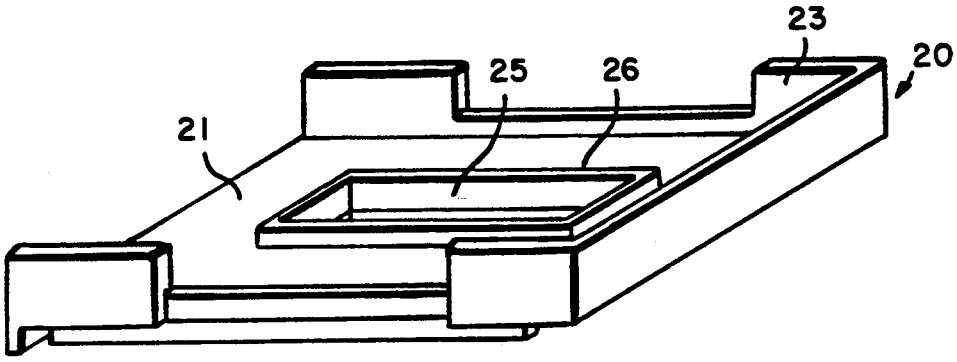
FIGS. 3A and 3B are isometric drawings of, respectively, the top and bottom of a first bobbin member for use in that transformer assembly.
Figure 3B:
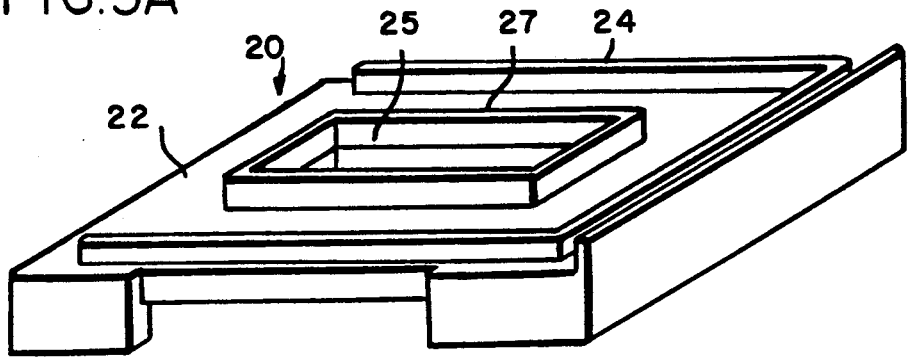

Referring to FIGS. 3A and 3B, the top and bottom of the first bobbin member 20 (sometimes called "bobbin A") are shown in respective isometric views. In FIG. 3B, the bobbin member is turned over, relative to its disposition in FIG. 3A. Bobbin member 20 is rectangular in over-all shape and has tray-like sides 23 and 24 that are perpendicular to both the top planar surface 21 and bottom planar surface 22. Bobbin member 20 also has a rectangular hole 25 in the middle. Hole 25 is ringed all around by walls 26 and 27 on the top and bottom. As illustrated, walls 26 and 27 are parallel to the tray sides 23 and 24 on both the top and bottom of the bobbin member. Other arrangements may suffice for the first bobbin member, of course, this configuration being exemplary only.

Figure 4D:
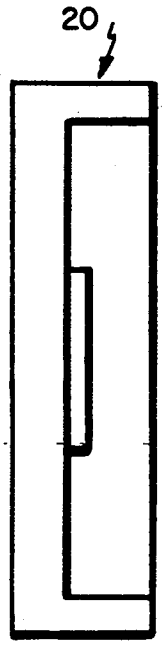
FIG. 4D is a left side view.
Figure 4A:
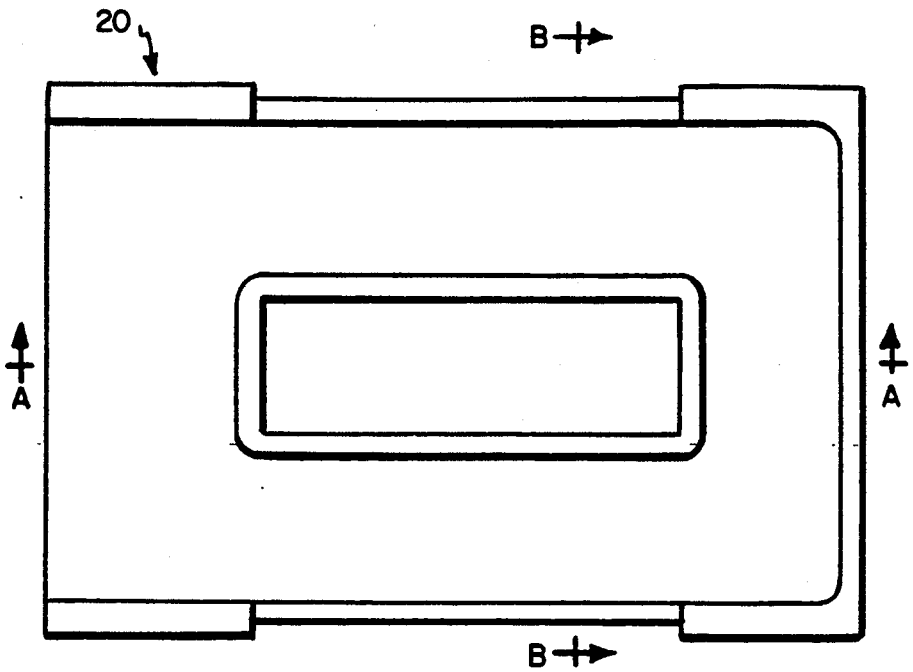
FIGS. 4A and 4B are, respectively, top and bottom plan views of the first bobbin member (bobbin A).
Figure 4C:
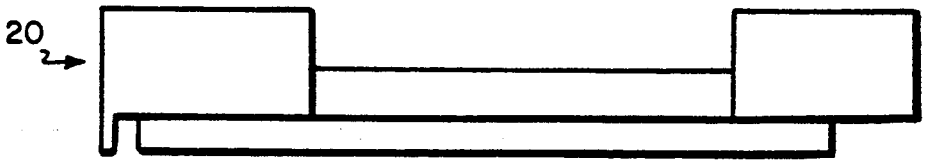
FIG. 4C is a front view.
Figure 4B:
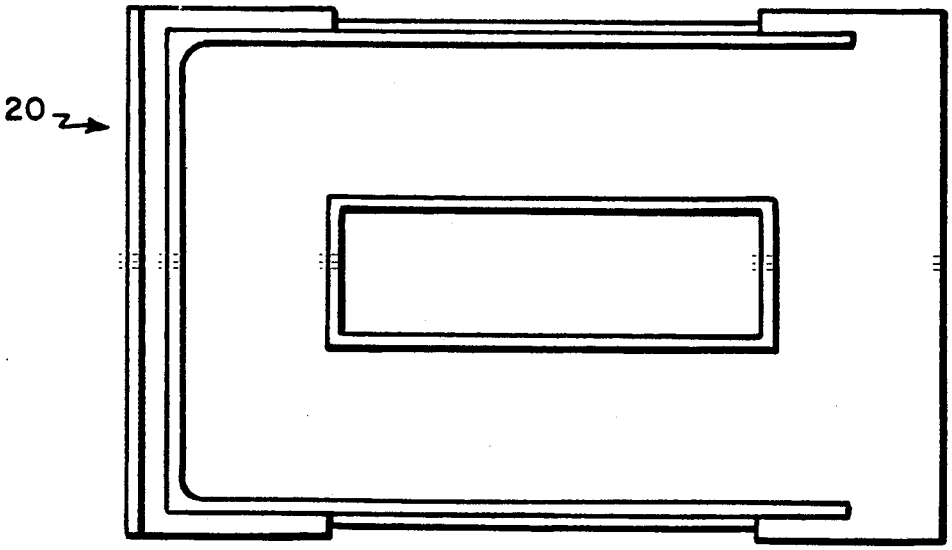
Figure 4E:
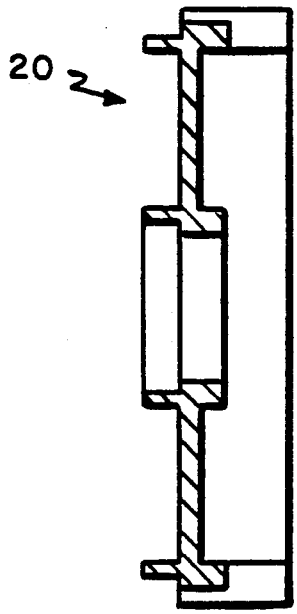
FIG. 4E is a side sectional view taken along the line B—B of FIG. 4A.
Figure 4F:
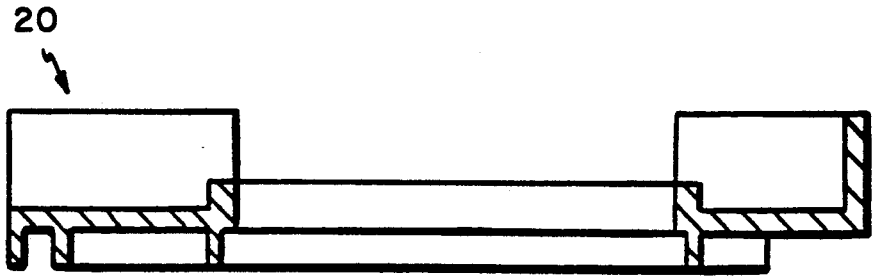
FIG. 4F is a sectional view taken along the line A—A of FIG. 4A.

FIGS. 4A-4D provide top, bottom, front and left side plan views of the first bobbin member 20. FIGS. 4E and 4F are cross sectional views.

Figure 5A:
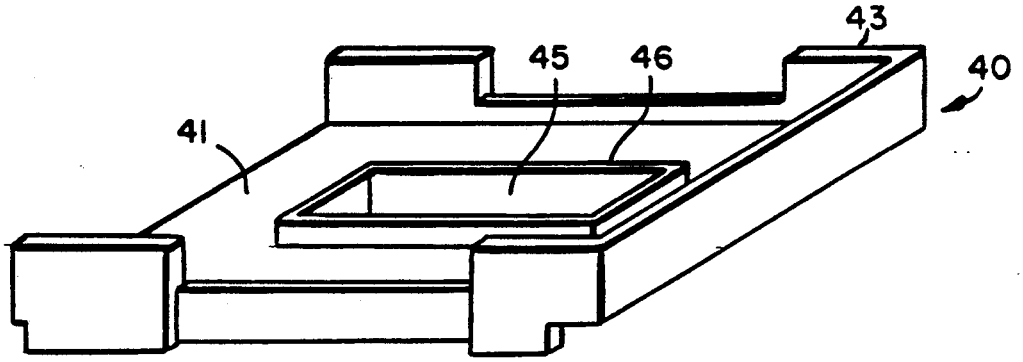
FIGS. 5A and 5B are isometric drawings of, respectively, the top and bottom of the second bobbin member shown in FIGS. 1, 2A and 2B.
Figure 5B:
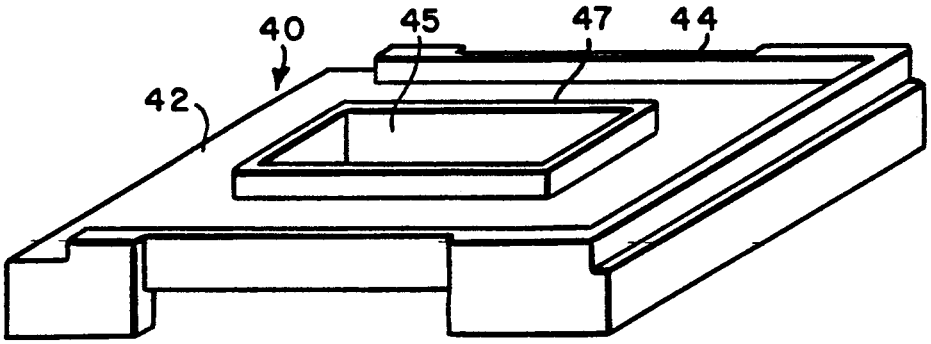

Referring to FIGS. 5A and 5B, the top and bottom of the second bobbin member 40 (also called "bobbin B") are shown in respective isometric views (with the bobbin member turned over in FIG. 5B, relative to its disposition in FIG. 5A). Bobbin member 40 is rectangular in over all shape and has tray-like sides 43 and 44 that are perpendicular to both the top planar surface 41 and bottom planar surface 42. Bobbin member 40 also has a rectangular hole 45 in the middle. Hole 45 is ringed all around by walls 46 and 47 on the top and bottom. As illustrated, walls 46 and 47 are parallel to the tray sides 43 and 44 on both the top and bottom of the bobbin member. If the first bobbin member takes on a different configuration, corresponding changes would be made in the second bobbin member.

Bobbin members 20 and 40 are similar, but not necessarily identical, parts. Upwardly-depending wall 46, 0.100" high and 0.020" thick, around hole 45 of bobbin member 40 is dimensioned to fit tightly inside the downwardly depending wall 27, 0.100" high and 0.020" thick, of bobbin member 20.

The bobbin members are preferably molded, but they may also be machined. While various insulating materials can be used, nylon has been found to work well.

Figure 6D:
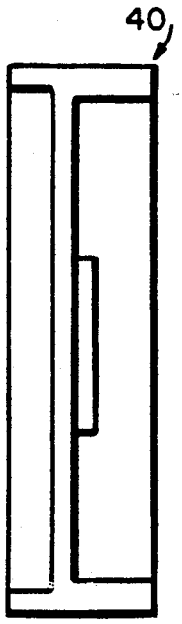
FIG. 6D is a left side view.
Figure 6A:
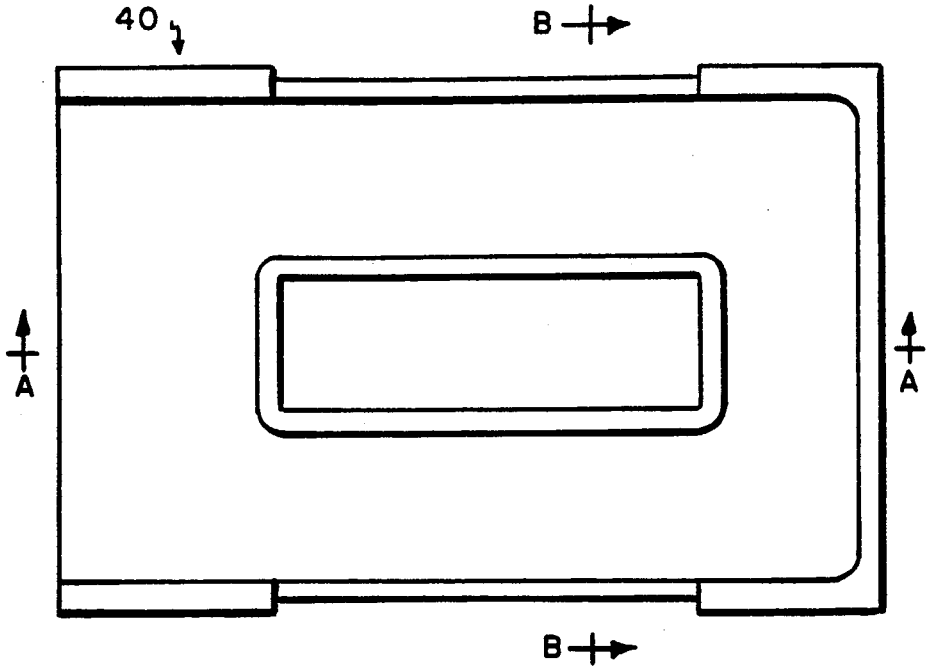
FIGS. 6A and 6B are, respectively, top and bottom plan views of the second bobbin member.
Figure 6C:
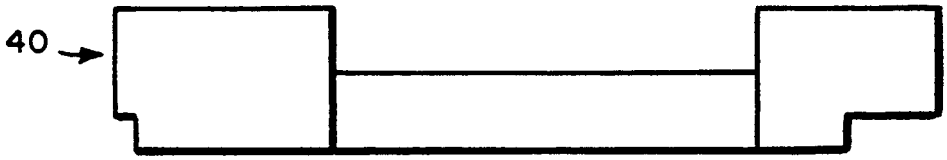
FIG. 6C is a front view.
Figure 6B:
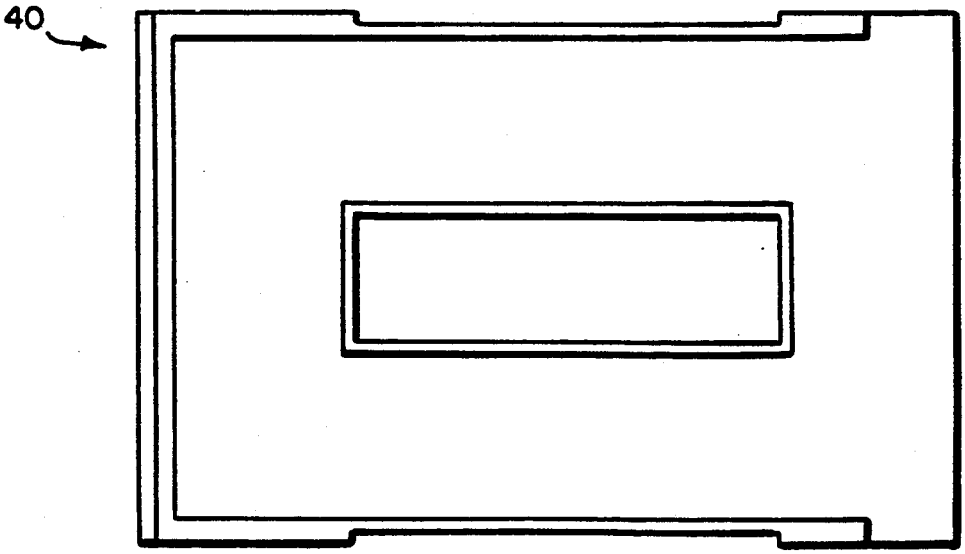
Figure 6E:
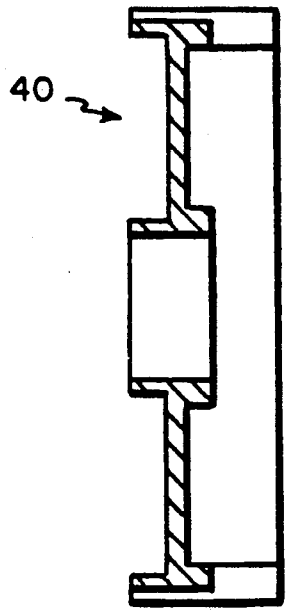
FIG. 6E is a side sectional view taken along the line B—B of FIG. 6A.
Figure 6F:
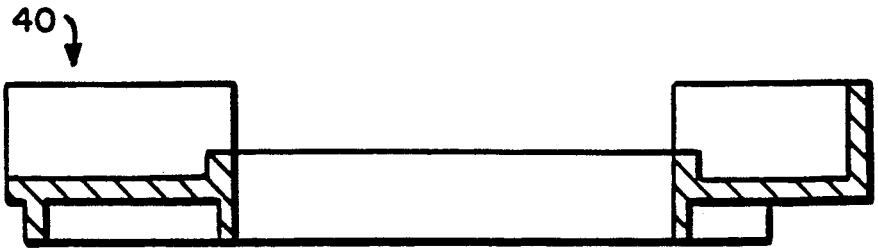
FIG. 6F is a sectional view taken along the line A—A of FIG. 6A.

FIGS. 6A-6D provide top, bottom, front and left side views of second bobbin member 40. FIGS. 6E and 6F are cross sectional views of bobbin 40.

Figure 7:
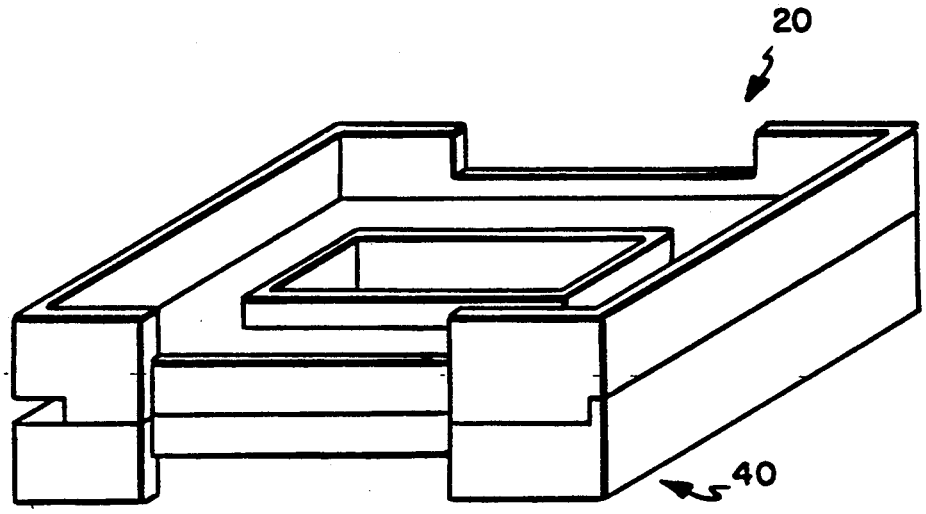
FIG. 7 is an isometric drawing of the two bobbins (bobbin A and bobbin B) fitted together.

FIG. 7 is an isometric view of the two bobbin members showing how they fit tightly together. The "bottoms" of the bobbin members face each other.

Figure 8B:
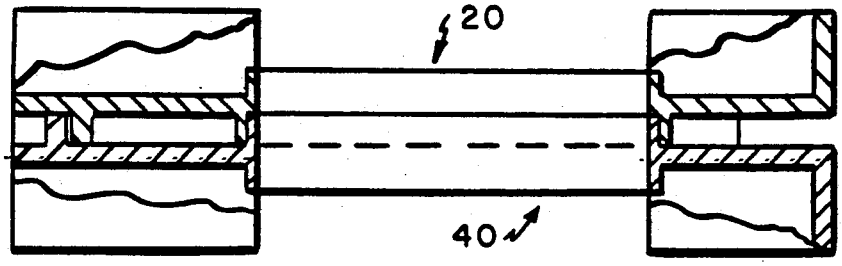
FIG. 8B is a front-sectional view of bobbin A and bobbin B fitted together, taken along the line A—A of FIG. 4A, and line A—A of FIG. 6A.
Figure 8A:
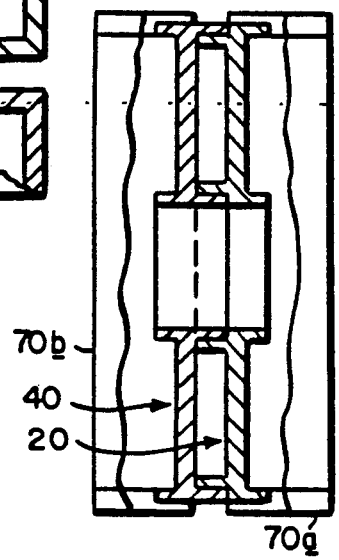
FIG. 8A is a side-sectional view of bobbin A and bobbin B fitted together, taken along the line B—B of FIG. 4A and line B—B of FIG. 6.

FIGS. 8A and 8B respectively show a front cross-sectional view and left side cross-sectional view of the two bobbin members fitted together.

Figure 9:
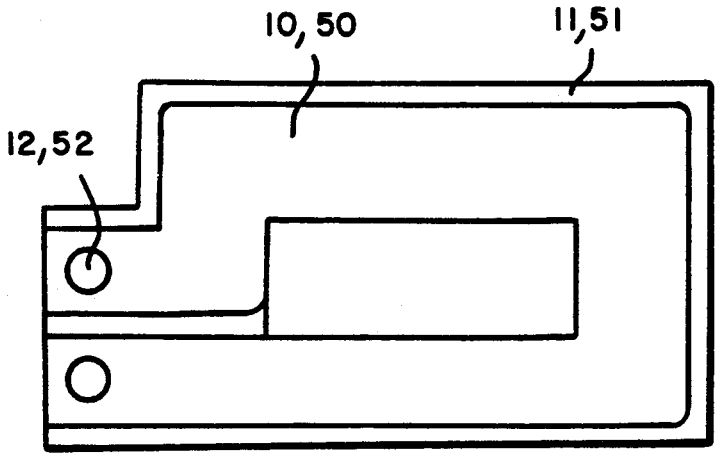
FIG. 9 is a top plan view of a PC board including a transformer winding, for use as a partial secondary winding in the transformer of FIG. 1.

FIG. 9 shows both the first planar winding 10 and fourth planar winding 50 on the respective first planar member 11 and fourth planar member 51. In this embodiment each planar member (11 and 51) contains the conductor pattern (i.e., windings 10 and 50) for half of the secondary winding. The secondary winding is completed by wiring windings 10 and 50 in series. Of course, windings 10 and 50 are identical in this example but they may, in general, be different. Planar windings 10 and 50 are 0.030" from any edge of planar members 11 and 51, respectively, that is positioned within the perimeters of bobbins 20 and 40.

Figure 10:
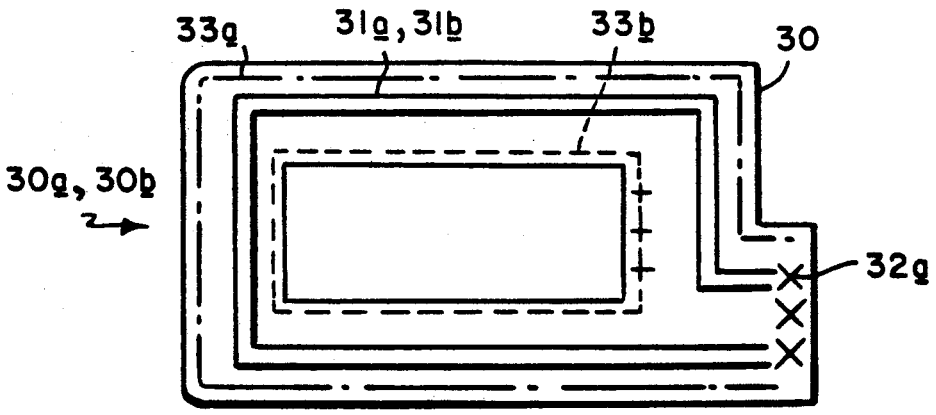
FIG. 10 is a top plan view of another PC board including a transformer winding for use as a partial primary winding.

FIG. 10 shows the top view of planar members 30*a* and 30*b*, and 31*a* and 31*b*. Planar members 30*a* and 30*b* are sized and shaped to fit into the space within the "tray" of bobbin member 20. Planar members 30*a* and 30*b* can have spiralling conductor traces, or some other wiring pattern, that carries transformer current. In this embodiment windings 31*a* and 31*b* are wired in series as one continuous primary winding of the transformer. The spiral traces of windings 31*a* and 31*b* carry the AC mains current of this transformer. The traces are of sufficient gauge to handle that current, and are within the area bounded by the dotted lines 33*a* and 33*b* so they are no closer than 0.020" to any edge of the planar member (e.g., PCB substrate) that is within the perimeters of bobbins 20 and 40.

Figure 11:
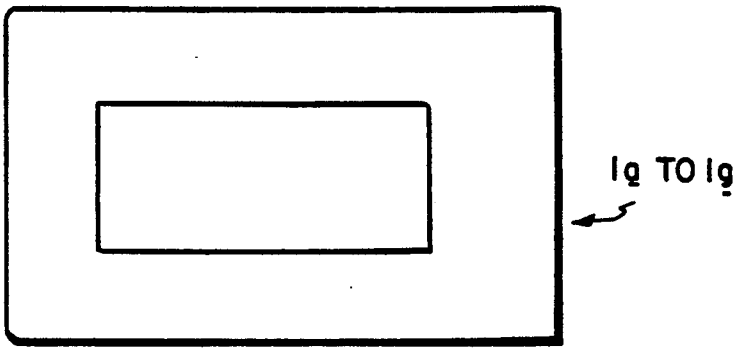
FIG. 11 is a top plan view of a dielectric insulator for use in the transformer.

FIG. 11 shows the thin insulating spacers 1*a*, 1*b*, 1*c* and 1*d*, 1*e*, 1*f*, and 1*g*. They may be stamped out of dielectric material (e.g., mylar or polyemide) that is 0.005"±0.001", so they are 0.004" thick or thicker. The seven spacers 1*a*, 1*b*, 1*c*, 1*d*, 1*e*, 1*f* and 1*g* typically have the same outside dimensions and central hole pattern as planar members 11, 30*a*, 30*b* and 51. One spacer is placed on top of planar member 11, one on top of planar member 51 to insulate them from the core, while the others are used to easily meet the *3*-ply specification for primary winding-to-SELV winding insulation.

Figure 12:
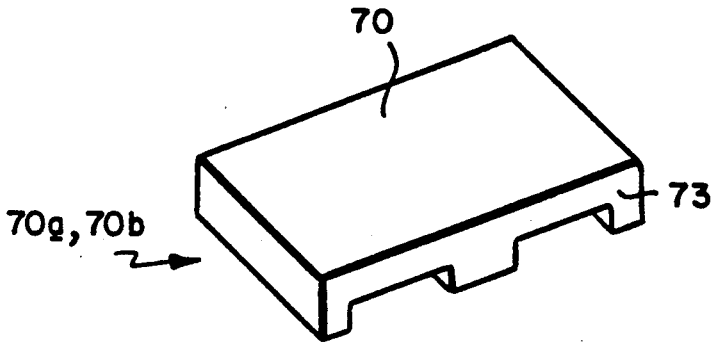
FIG. 12 is an isometric drawing of one half of the E-shaped magnetic core of the transformer.

FIG. 12 is an isometric drawing of one of the two identical "E"-shaped ferrite core members 70*a* and 70*b* used in this embodiment. The central projection is 0.250" wide, while each end projection is 0.125" wide. The lengths of the three projections (71, 72 and 73) of the core members are 0.250" from the top surface such that the cores 70*a* and 70*b* fit snuggly around the bobbin members, planar elements and spacers of the assembly with their E projections contacting each other. The two core members may be glued together.

In order to fully understand the uniqueness and desirability of the laminated assembly of the above-mentioned parts, it is important to understand how the safety agencies measure conductor-to-conductor isolation, and what minimum distances they impose on those measurements for a power transformer.

Figure 13:
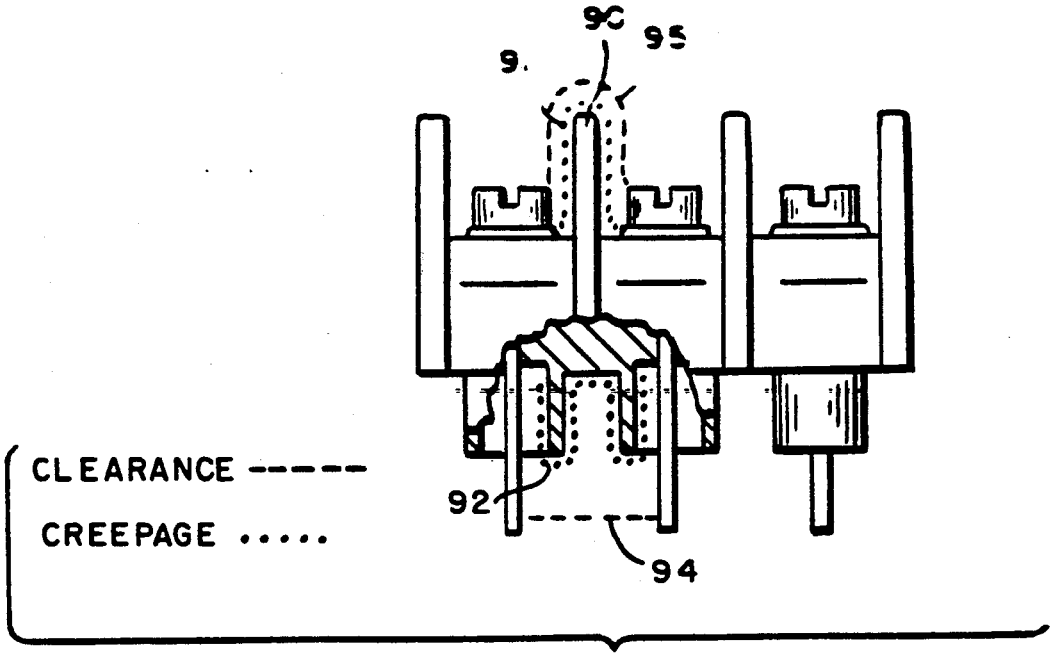
FIG. 13 is an end view diagram illustrating an example of "clearance" and "creepage" measurements on a generic arrangement of electronic parts.

There are two important measurements used to determine the electrical isolation between conductors, these are "creepage" and "clearance". As stated above, "Creepage" is defined as the shortest path between two conductive parts or between a conductive part and the grounding surface of the equipment measured along the surface of the insulation. It is important to note that creepage is measured along the surface of the insulation between two conductors. FIG. 13 defines the paths 91 and 92 along which the creepage measurement would be made in two different situations. "Clearance" is a similar measurement of conductor-to-conductor separation, but it is made through air, along the shortest path between conductors. "Clearance" is the shortest distance between two conductive parts as measured through air, as in path 94. If a barrier is interposed (e.g., 90), the spacing is measured around the barrier, as in path 95. If a barrier between conductors consists of two or more uncemented pieces, the spacing is measured through a joint or around the barrier, whichever is least.

"Creepage" and "clearance" are measured between all conductors, conductors and terminals, grounded or ungrounded conductive parts, components and component leads in a transformer The worst case safety requirements for power transformers, in the V.D.E, UL and C.S.A standards for off-line transformers, are: (A) the primary winding-to-SELV winding (Safe Extra Low Voltage winding) insulation thickness must be either one insulator that is at least 2 mm (0.080") thick, or three layers of insulation each at least 0.1 mm (0.004") thick (i.e., 3 plys); (B) the "creepage" and "clearance" between the secondary winding and either line or neutral must be at least 6 mm (0.240); (C) the "creepage" and "clearance" between the core and either line or neutral must be at least 2 mm (0.080").

To understand how the transformer design of this invention meets the above specifications, while keeping a low profile, the assembly itself is now reviewed.

Referring again to FIG. 1, it is seen that the transformer can be assembled by the following exemplary steps: First, planar member (PM) 31*a* (which is not expressly shown, to avoid unnecessary obfuscation, but which carries winding 30*a*) is placed on the bottom side 22 of bobbin member 20. The lip 27 around hole 25 in bobbin 20, locates the PM and holds it in place. Next, a thin dielectric insulator 1*d* is placed over PM 31*a*, then PM 31*b* (which also is not expressly shown, to avoid unnecessary obfuscation, but which carries winding 30*b*) is placed on top of it. Bobbin member 40 is placed over PCB 31*b*, onto bobbin 20, with the hole 45 and lip 47 of bobbin member 40 fitting tightly inside the hole 25 and lip 27 of bobbin member 20.

At this point, windings 30*a* and 30*b* are sandwiched between bobbin members 20 and 40 with the connection points 32*a* and 32*b* (i.e., solder leads) of those windings projecting out of the left end of the tightly fitted bobbins (see FIG. 1). Next, two dielectric insulators 1*c* and 1*b* are placed on top of bobbin member 20, then PM 11 (with winding 10) is placed on the outer surface of the sandwich formed by the top of tray 21 of bobbin member 20. Next, two dielectric insulators are placed on the outer surface of bobbin member 40, then PM 51 (with winding 50) is placed on the outer surface of the sandwich formed by the top of tray 41 of bobbin member 40. Spacers 1*a* and 1*g* are placed over PM's 11 and 51, respectively, as two new outer layers of the sandwich. PM's 11 and 51 have the connection points 12 and 52 (i.e., solder leads) of windings 10 and 50 projecting out of the right end of the bobbin trays (see FIG. 1). The two E-shaped ferrite core members 70*a* and 70*b* are now placed around the entire sandwich so that their middle projections fit snuggly into the hole (26, 46) in the middle of the PM bobbin sandwich. The core-PM-bobbin-sandwich can be pressure-fit together, or, for anti-tampering purposes, a conventional industrial glue may be placed on the mating surfaces of the core members, and pressure applied while the glue cures. The proper leads on windings 10 and 50 are soldered together to join the two halves of the secondary into one continuous winding. Or, the leads can be soldered to put the winding 10 in parallel with winding 50. The proper leads on windings 31*a* and 31*b* are also soldered together to join the two halves of the primary in series. Other windings (on the same or other PM's) and spacers can be added as desired.

Now that the transformer assembly has been described, it is apparent that little labor is required to assemble it. Furthermore, it should be evident to someone skilled in the art that the assembly procedure could be automated if desired.

The height of the exemplary low profile transformer described above is approximately 0.500".

Earlier in the text there is an outline of the three critical specifications that any transformer must meet to be useful in consumer applications.

Figure 14:
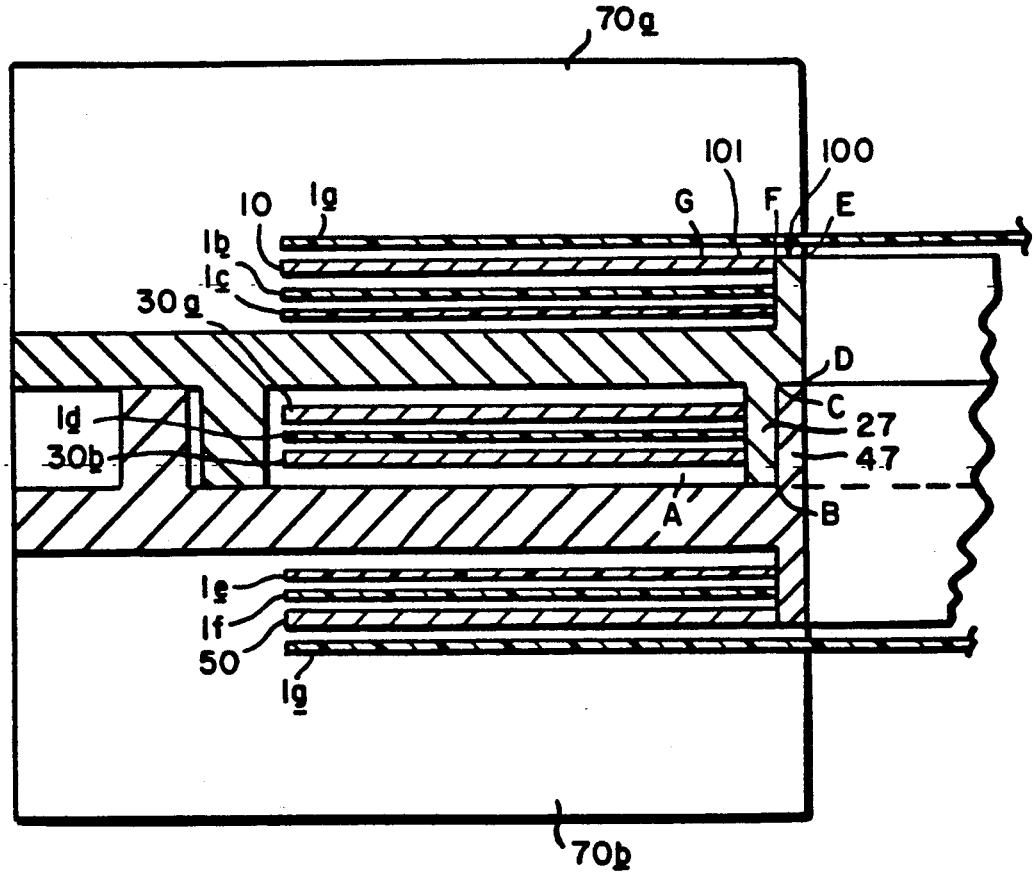
FIG. 14 is an enlarged reproduction of the view of FIG. 8B, annotated to show the creepage and clearance measurements for the transformer of the present invention.

The first specification requires that the insulation from primary winding-to-SELV winding be either 0.080" as a single layer or three layers of at least 0.004" each. Between the bottom side of PM 11 and the top side of PM 31*a*, FIG. 14 shows two insulators (i.e., spacers) of 0.005"±0.001" each, and bobbin A of 0.020" to 0.025", thus, complying with the 3-ply requirement. The second specification requires that the creepage and clearance between the primary and secondary be at least 0.240". The earlier discussion of FIG. 13 showed how creepage and clearance are measured in general. Referring to FIG. 14 for the creepage and clearance in the illustrated embodiment, path 101 shows the creepage and the clearance, between the primary and secondary through the center hole, which is the path of the worst case (i.e., minimum) creepage and clearance in this transformer. Creepage and clearance path 101 starts at point A, the outermost extent of the etch on PM 31*b*, which is manufactured to be no closer than 0.030" from the edge of the PM in this embodiment. Path 101 proceeds under wall 27, which is 0.020" thick, to point B. Let the length of a path X from a defined starting point (in this case, at the outer edge of the etch on PM 31*b*) to a location along the path be designated "LEN(X)" and let the length along the path from point A to point B be designated "AB". Using this notation, at B, LEN(71)=0.030"+0.020"=0.050". Creepage and clearance path 101 now proceeds between walls 27 and 47 to point C. At point C, LEN(101)=0.050"+0.100"=0.150". The path continues from C to D, thus adding another 0.020", then to point E. At point E, the path length is LEN(101)=0.030"+0.020+0.100"+0.020"+0.070". From E to F adds 0.045", and F to G adds another 0.030". So $$\text{LEN}(101) = AB + BC + CD + DE + EF + FG = 0.050'' + 0.100'' + 0.020'' + 0.070'' + 0.045'' + 0.020'' = .305''$$

which is greater than the required 0.240" shown as the second specification.

The third specification requires that the creepage and clearance between the core and the primary (line or neutral) be at least 0.080". Path 100 is the same as Path 101 from point A to point E. This path demonstrates the minimum creepage and clearance path from the core to the primary winding on PM 30*a*.

$$LEN(100)=LEN(101-EF-FG)=0.305''-0.045''-0.020''=0.230''$$

Therefore path 100 is greater than 0.080". Thus the transformer meets the third requirement.

Consequently, the resulting package can easily meet all isolation requirements and still be a very low profile, and extremely compact transformer. Hence, there is shown herein an excellent way to construct a low-profile planar transformer that can be manufactured easily and inexpensively, and be used successfully as a line transformer in off-line switching power supplies that operate at MegaHertz frequencies.

It should be obvious to anyone practiced in the art, that although one embodiment of the transformer has been shown herein, there are many variations that can be made without departing from the spirit of the invention. One such variation is to reverse the placement of the primary and secondary windings (which might require additional or thicker insulating washers). Another variation would be to treat the two secondary windings as independent secondary windings. Yet another version would be to omit the separate insulators that are on each side of PM 11 and PM 51. Another would be to change the number of insulators in each cavity while adhering to the three ply specification. Still another formulation would be to use stamped metal parts formed from a conductive metal sheet that is not secured on a substrate, rather than PC boards for any or all of windings 10, 30*a*, 30*b* and 50. Another alternative would be to use bobbin members which are round or oblong or some other shape, with similarly shaped PM's, windings and spacers, rather than rectangular elements. Still another variation would be to use only two PM's with two bobbin members. Alternately, the transformer could also be constructed with more than two bobbins in a multi-cavity type of construction. Many other variations on this invention can be made by using different combinations of magnetic elements that are shaped as E-cores, I cores, R cores, Pot cores, and so forth. Other variations can exist specifically for making high voltage transformers, or isolation transformers that do not have to meet the UL/VDE/CSA specifications. Accordingly the invention is defined not by the illustrative embodiment, but only by the following claims and their equivalents.

What is claimed is:

1. A transformer assembly comprising:

a. first and second bobbin members of insulating material, each said bobbin member having a pair of opposed planar surfaces defining a central aperture therein, at least one of the bobbin members having a raised wall extending from each surface and encircling said aperture;

b. a first planar conductive winding disposed adjacent a first surface of the at least one bobbin member;

c. a second planar conductive winding disposed adjacent a second surface of the at least one bobbin member;

d. first and second core members;

e. insulation means between the first winding and the first core member; and f. the first and second core members defining a magnetic path through the central aperture and linking the first and second windings.

2. A transformer assembly comprising:

a first and second bobbin members of insulating material, each said bobbin member having a pair of opposed planar surfaces defining a central aperture therein, and a raised wall extending from each surface and encircling said aperture;

b. a first planar conductive winding disposed adjacent a first surface of each of the bobbin members;

c. a second planar conductive winding disposed adjacent a second surface of each of the bobbin members;

d. first and second core members;

e. first insulation means between the first winding on said bobbin member and the first core member;

f. second insulation means between the second winding on said second bobbin member and the second core member;

g. at least one insulating spacer between each of the windings and the bobbin members; and h. the first and second core members defining a magnetic path through the central aperture and linking the first and second windings.

3. The transformer of claim 2 wherein the conductive windings, the bobbin members spacers and the first and second insulation means are dimensioned such that (i) the insulation from the first winding to the second winding is at least three layers of at least 0.004" thickness each;

(ii) the creepage and clearance between the first and second windings is at least 0.240"; and (iii) the creepage and clearance between the core members and the primary winding being at least 0.080", the primary winding being that one of the first and second windings intended for connection to a.c. mains.

* * * * *